United States Patent [19]

Affolter

[11] Patent Number: 4,594,008

[45] Date of Patent: Jun. 10, 1986

[54] WATERTIGHT CASE FOR WATCHES

[75] Inventor: Walter Affolter, Zurich, Switzerland

[73] Assignee: Mondaine Watch Ltd., Switzerland

[21] Appl. No.: 692,636

[22] Filed: Jan. 18, 1985

[30] Foreign Application Priority Data

Jan. 23, 1984 [CH] Switzerland ..... 281/84

[51] Int. Cl.[4] ..... G04B 37/00

[52] U.S. Cl. ..... 368/276; 368/292; 368/294

[58] Field of Search ..... 368/88, 276, 281–282, 368/288, 291–292, 294–295, 299–300, 309

[56] References Cited

U.S. PATENT DOCUMENTS

| | | | |
|---|---|---|---|
| 3,264,820 | 8/1966 | Piquerez | 368/291 |
| 3,948,038 | 4/1976 | Takagi | 368/291 |
| 4,083,178 | 4/1978 | Sekiguchi et al. | 368/276 |
| 4,132,062 | 1/1979 | Fujimori | 368/294 X |
| 4,218,873 | 8/1980 | Lang | 368/281 X |
| 4,223,527 | 9/1980 | Tutiya et al. | 368/283 |
| 4,257,118 | 3/1981 | Futaba et al. | 368/276 |
| 4,447,162 | 5/1984 | Mitamura et al. | 368/295 |

FOREIGN PATENT DOCUMENTS 2111931 11/1971 Fed. Rep. of Germany ..... 368/276

*Primary Examiner*—Vit W. Miska

*Attorney, Agent, or Firm*—Kane, Dalsimer, Kane, Sullivan and Kurucz

[57] ABSTRACT

A wrist watch case comprising a crystal bezel provided, on the depending walls covering the strap fixing sides, with diametrally opposed recesses. A first recess is adapted to receive a projection formed on the case periphery and a releasable locking member in the form of a U-shaped clamp is located in the other recess, the side legs of this clamp being adapted to be inserted into corresponding holes formed in the case periphery. The projection and the locking member, in the assembled watch condition, bear on the corresponding wall sections of the relevant depending crystal bezel walls which limit said recesses on their lower sides, thus effecting a perfect compression of the gasket clamped between the crystal bezel and the upper edge of the middle of the watch case and ensuring a reliable watertightness even in case of large tolerances of the cooperating parts. The releasable locking member may also consist of a small plate or a spring blade.

7 Claims, 11 Drawing Figures

WATERTIGHT CASE FOR WATCHES

FIELD OF THE INVENTION

This invention relates to a watertight case for watches, notably wrist watches, which comprises a crystal holding bezel and a gasket tightly clamped between the crystal and the upper edge of the middle of the case.

THE PRIOR ART

Up to now, watch cases of this character required either close tolerances for the dimensions of the component elements, or special constructional measures in order to exert a uniform compression on the gasket, so that the manufacture of the case elements and the assembly of the watch case were more or less complicated and expensive.

SUMMARY OF THE INVENTION

It is the primary object of the present invention to simplify the construction and assembly of a watertight watch in such a way that when closing the case a reliable gasket compression and consequently an adequate degree of watertightness can still be obtained even though the dimensions of the cooperating parts have relatively large tolerances, and that furthermore the case can easily be opened for repairing the watch.

According to the invention there is provided a watertight watch case comprising a middle, a crystal bezel and a gasket between said bezel and the upper edge of said middle, said bezel having on each opposed strap fixing side a depending wall encompassing said middle, in which a recess is formed, the peripheral wall of said middle further comprising on one of the strap fixing sides a projection formed integrally with said peripheral wall limited by a bearing face extending substantially at right angles and radially from said wall and adapted in the assembled condition to engage said recess formed in said depending wall of said bezel, whereby said bearing face, responsive to the resilient pressure of said gasket, is pressed against the lower limiting surface of said recess, the opposite strap fixing side being provided with a locking member adapted releasably to engage the peripheral wall of said middle and to be received and locked in the other recess of the wall of said crystal bezel due to the resilient action exerted by the compressed gasket against the lower limit wall of said other recess, thus firmly holding in position the crystal bezel by pressing said bezel against said middle.

Appropriate further embodiments of the invention are described in the dependent claims.

The invention will now be described more in detail with reference to the attached drawings showing by way of example different embodiments of a wrist watch with its releasable locking means.

THE DRAWINGS

DESCRIPTION OF THE PREFERRED EMBODIMENTS

Figure 1:
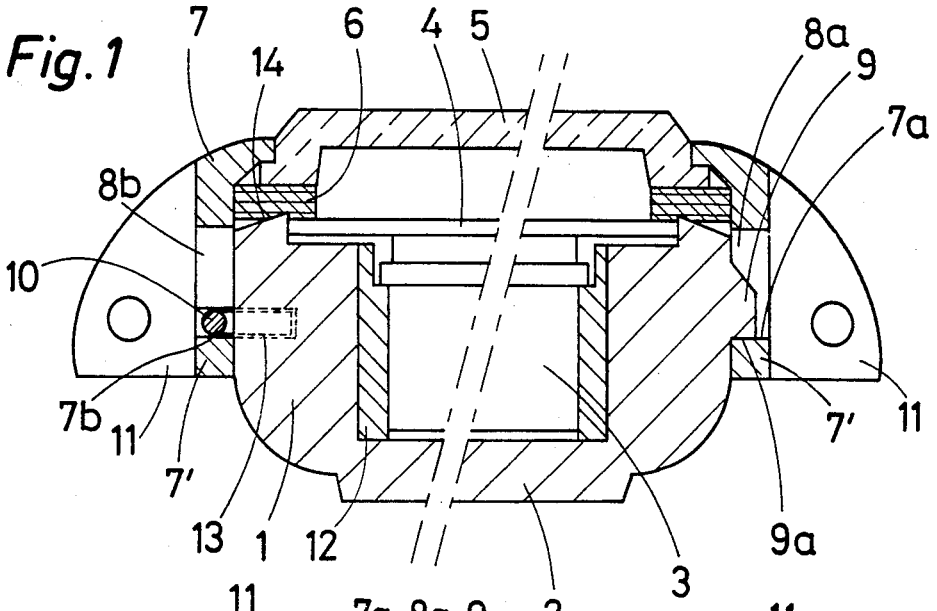
FIG. 1 is a section taken across a wrist watch according to a first form of embodiment of the invention.
Figure 2:
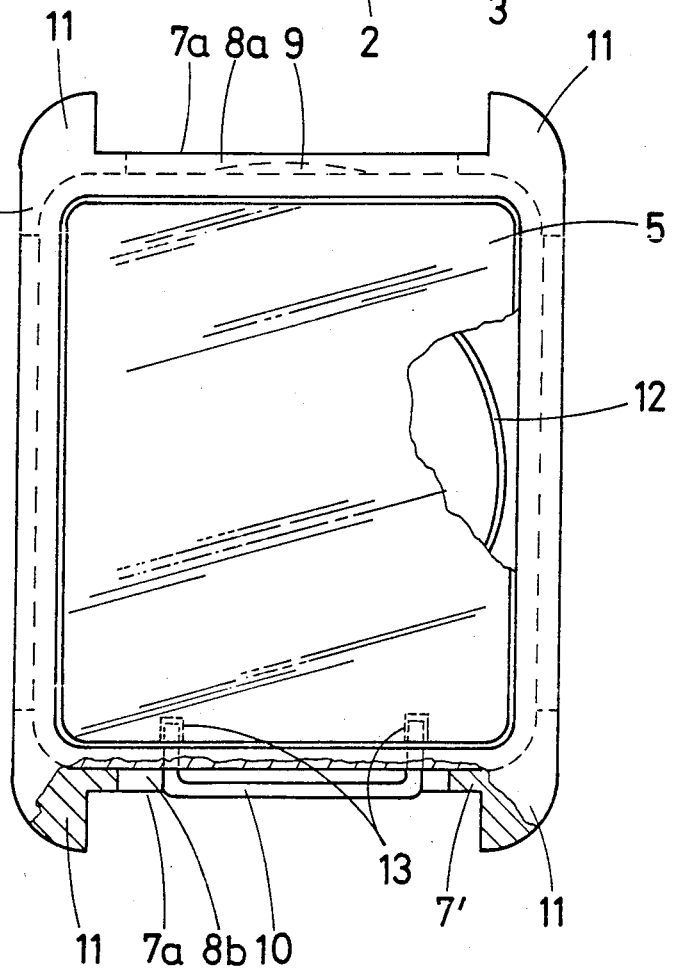
FIG. 2 is a plane view from above of the same watch, without the dial, showing in part-section the small side of the crystal bezel to which the detachable, clamp-like locking member is fitted.
Figure 3:
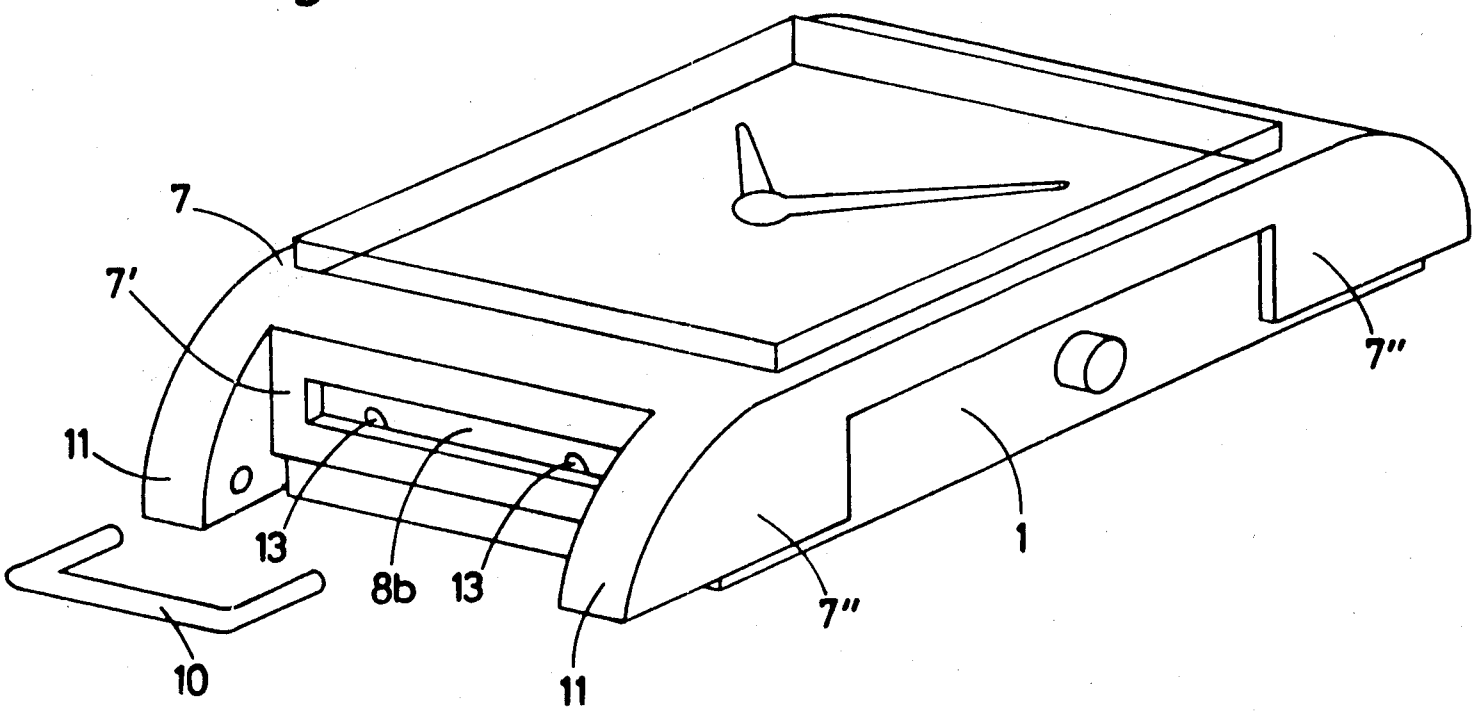
FIG. 3 is a perspective view of the same watch, in which the clamp is shown after its release from the watch case.
Figure 4:
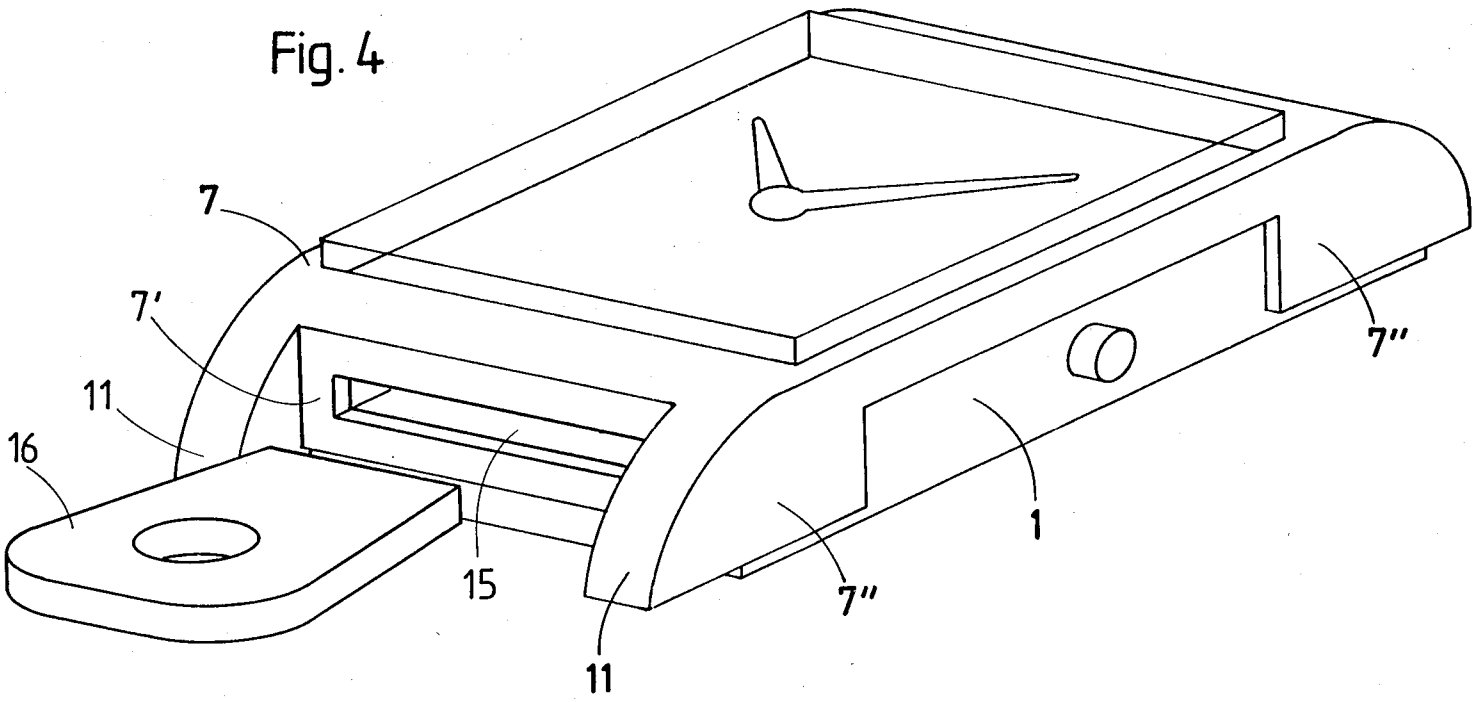
FIG. 4 is a perspective view showing a second form of embodiment of the watch according to the present invention, in which the locking member consists of a small, disc-shaped plate.
Figure 5:
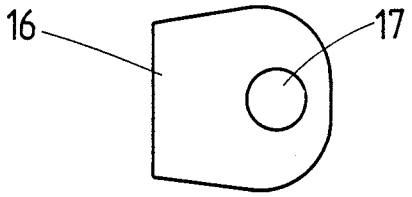
FIG. 5 is a plane view from above showing the locking member of FIG. 4.
Figure 6:
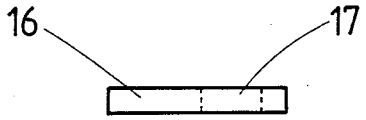
FIG. 6 is a side elevational view of the same locking member.
Figure 7:
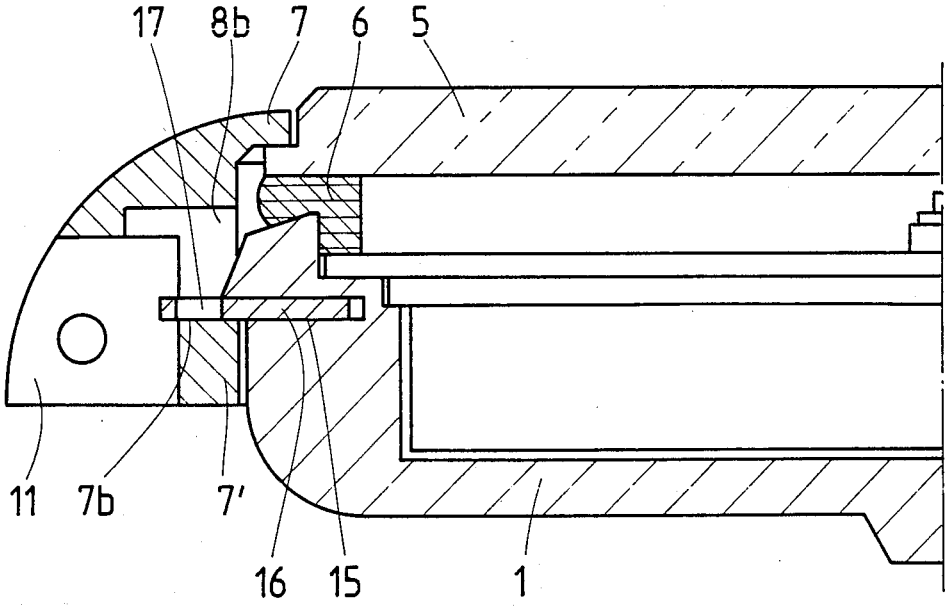
FIG. 7 is a fragmentary longitudinal section showing one portion of the wrist watch according to the second form of embodiment of the invention.
Figure 8:
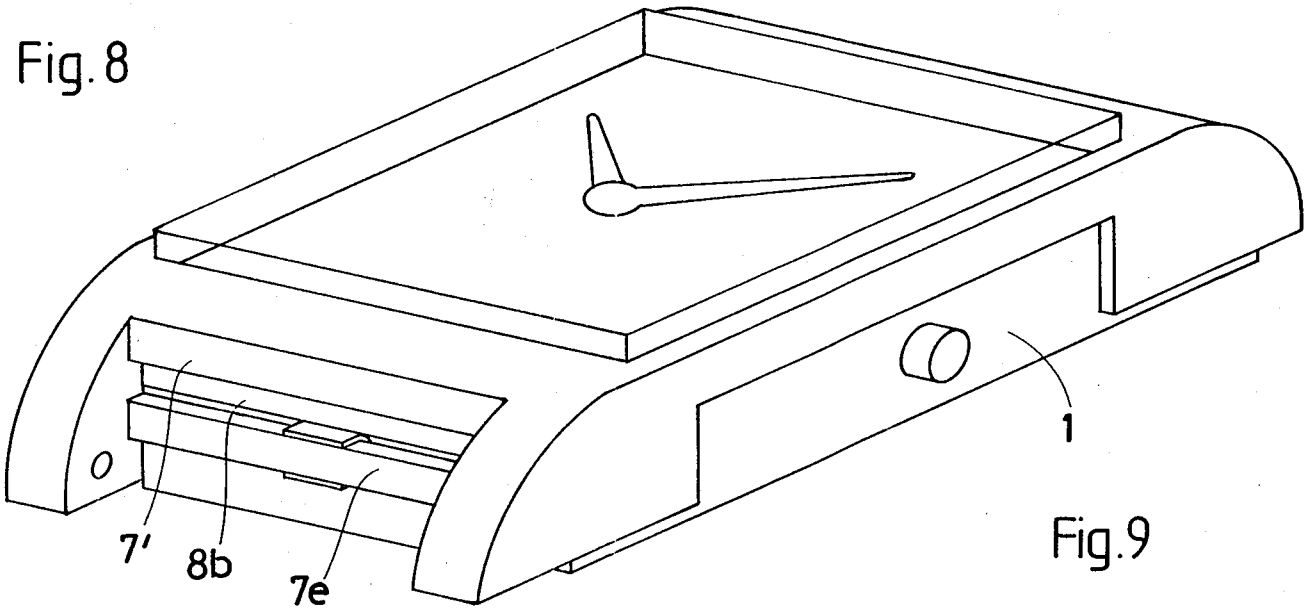
FIG. 8 is a perspective view of a third form of embodiment of the invention.
Figure 9:
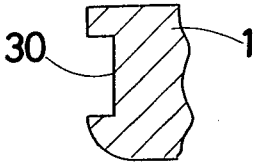
FIG. 9 is a part-sectional view taken across the small side of the one-piece case shell of the watch of FIG. 8 in which a recess adapted to receive the releasable locking member is formed.
Figure 11:
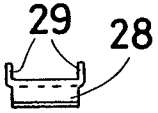
FIG. 11 is a side elevational view of the same holding spring.
Figure 10:
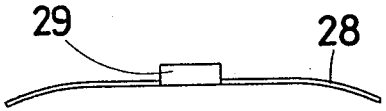
FIG. 10 is an elevational view of the holding spring constituting the releasable locking member.

Referring now to the drawings and more particularly to FIGS. 1–3 thereof, the rectangular wrist watch illustrated therein comprises a middle 1 and a bottom 2 of the watch case constituting together a one-piece case shell in which the clockwork-movement 3 is assembled by means of a movement ring 12. The dial 4 overlaps an inner annular shoulder formed on the upper face of the case shell. The crystal 5, previous insertion of a gasket 6, is fitted on the upper edge 14 of the case shell, and held in position by a rectangular crystal bezel 7 provided on its four sides with depending wall extensions 7′,7″. These wall extensions 7′,7″ overlap the middle 1 of the wrist watch case and the small-side extensions 7′ are locked in relation to the corresponding small sides of the peripheral walls of the case.

For this purpose, the wall 7′ of the right-hand small side of crystal bezel 7, as seen in FIG. 1, comprises a recess **8*a* in the form of an elongated rectangular aperture adapted in the assembled condition of the watch case to be engaged by a projection 9 formed integrally with the peripheral wall of the corresponding small side of the middle 1 of the watch case. This projection 9, of substantially saw-tooth configuration in cross-section, is provided on the side facing the crystal 5 with a sloping surface and bounded on the side opposite the crystal 5 by a bearing face 9*a* projecting radially and outwardly from, and at right angles to, the peripheral wall of the middle 1, this bearing face abuting the lower terminating face 7*a* of said recess 8**.

On the opposite small side (on the left as seen in FIG. 1) the wall 7′ of crystal bezel 7 is also provided with a recess **8*b* in the form of a rectangular aperture. The watch can be locked on this small side by means of a releasable locking member 10 consisting of a U-shaped clamp preferably of metal. The legs of this clamp 10 are adapted to be inserted into blind holes 13 formed at a proper spacing from each other in the middle 1 of the watch case. Access to these holes 13 can be had through said recess 8*b* when the crystal bezel 7 is pressed against the case shell while compressing the gasket 6. The legs of clamp 10 can be inserted into the corresponding holes 13** to such an extend that when the watch is assembled and locked the clamp portion projecting from said holes 13 bears on the lower edge 7*b* of recess 8*b*, as clearly shown in FIG. 1.

In the above-described example and also in the other exemplary forms of embodiment of the present invention, strap or wristlet fixing lugs 11 are formed integrally with the small sides of crystal bezel 7, on either side of recesses 8*a* and 8*b*, so that the fabrication of the watch case is further simplified. Of course, it is also possible basically, to provide other means for fixing the wrist watch straps or wristlets.

To assemble the watch, the case shell 1, 2 and the crystal bezel 7 overlapping with its inner edge the edge of crystal 5 are firstly pressed again each other at the right-hand small side comprising the projection 9, so that the lower edge of the wall 7′ of crystal bezel 7 which engages first the sloping surface of said projection 9, during the compression of gasket 6 on the same side, will slip away from projection 9 to such an extent that this projection 9 will penetrate into said recess 8*a*, thus causing the bearing surface 9*a* of projection 9 to bear on the lower wall 7*a* of said recess 8*a*. Then, the crystal bezel 7 and the watch case shell 1,2 are pressed against each other while compressing the gasket 6 on the other small side, which is the left-hand side as seen in FIG. 1, so that the legs of clamp 10 can penetrate through the recess 8*b* into the holes 13 of the middle 1. The projecting portion of clamp 10, due to the resilient force of the compressed gasket 6, is pressed against the lower edge 7*b* of recess 8*b*, therefore on the section of wall 7′ which constitutes the lower limit of the wall 7′ of crystal bezel 7. Thus the gasket 6 is perfectly compressed and an efficient watertightness combined with a reliable interlocking of the component elements of the watch case are achieved. When the watchmakers wants to open the watch case, he just has to pull out the clamp 10 by using a suitable tool, thus causing the crystal bezel 7 and the case shell 1,2 to be separated from each other by a hinge movement, whereafter the other small side of the case can be separated from each other by pulling out the projection 9 from recess 8*a*.

To facilitate the compression of gasket 6 while improving the resultant sealing action, the upper edge 14 of the watch case, engaged by said gasket 6, may be inclined so that when these parts are pressed against each other the upper ridge of the upper edge 14 will penetrate into the gasket material during the local compression of this gasket 6. The diameter of gasket 6 is somewhat greater than the diameter of the upper edge 14 of the case shell, and it inner edge overlaps the dial 4 which in this manner is safely held in position by means of gasket 6.

In the following examples of a watch according to the present invention the watch case is locked on one of its small sides by means of the projection 9 of the middle 1 of the case, which penetrates into the recess 8*a* of wall 7′ of bezel 7, in the manner already described hereinabove with reference to the first form of embodiment shown in FIGS. 1–3 of the drawings. Therefore, it is unnecessary to repeat the description of the structure of this particular small side of the watch case in the following description of other forms of embodiment of the invention. In the following examples, the differences lie in the making and arrangement of the releasable locking means provided on the other small side of the case. For the sake of simplicity the watches of the following examples correspond generally to that of the watch shown in FIGS. 1–3 which is of rectangular configuration, with a substantially similar crystal bezel 7 and a likewise similar one-piece case shell combining the middle 1 and the bottom 2.

In the example shown in FIGS. 4–7 the locking member consists if a small disc-like plate 16, adapted to be inserted into a slot 15 formed in the middle 1 and extending parallel to the crystal 5, for the purpose of fixing the crystal bezel 7 to said middle 1 through the recess 8*b* formed in the wall 7′ of crystal bezel 7. In the assembled condition, the portion of plate 16 which projects from slot 15 bears on the lower wall 7*b* limiting the recess 8*b* and is firmly pressed against this wall 7*b* by the resilient force resulting from the elastic compression of gasket 6. To permit the removal of plate 16 from its slot 15 for the purpose of opening the watch case, the external portion of plate 16 is provided with a hole 17 or a notch engageable by a suitable tool when it is desired to extract the plate 16. Furthermore, in order safely to wedge the plate 16 in its slot 15, this plate 16 (as shown in plane view in FIG. 5) is wedge-shaped or in other words its width decreases in the direction of its end engaging said slot 15. The shape of this slot 15 corresponds of course to that of said plate 16.

In the examples shown in FIGS. 8–11 of the drawings the locking member 28 is a curved spring blade provided in its intermediate portion with a pair of clamp-forming wings 28 extending substantially at right angles to the plane of the spring blade proper. This spring blade 28 is slightly curved in its unstressed condition, the wings 29 projecting from the convex face of the spring. This spring blade 28 fits in a cavity 30 formed in the outer wall of the small side of the middle 1 with the wings 29 facing outwards. This cavity 30 is located just behind the corresponding wall 7′ of the crystal bezel which defines the lower limit of wall section 7*e*. In the assembled condition the wings 29 of the essentially unstressed and therefore curved spring blade 28, which project from said cavity 30, will encompass the top and bottom edges of said wall section 7*e*, so as to lock the watch case. When it is desired to close or open the watch case it is simply necessary to flatten the spring by pressing it home in said cavity 30, so that the wings 29 will collapse into this cavity 30 to the extent necessary for enabling the wall section 7*e* of the crystal bezel wall 7′ to slide off the corresponding peripheral wall of the middle 1 or case shell.

The watch according to the present invention can thus be assembled quite easily to its final condition, thus constituting a perfectly water-tight watch case even when the dimensions of its component elements are fabricated with relatively large tolerances. With the same facility the watchmaker can open the watch by simply releasing the locking member.

The invention is not limited by the form of embodiment shown and described herein, since various modifications may be brought notably to the shape and fabrication of the middle of the watch case, crystal bezel and gasket, and even to the locking member proper, without departing from the basic principles of the invention.

Likewise, it is also possible to provide the locking projection on one of the peripheral sides of the case, and the releasable locking member on the opposite side of the case, and the cooperating parts of the crystal bezel may be provided, for the purpose of interlocking the parts, at a location other than the sides where the wrist watch straps are disposed.

What is claimed is:

1. A watertight case for a watch comprising a middle, a crystal bezel and a gasket clamped between the crystal and the upper edge of said middle of the case, wherein said crystal bezel comprises on each opposed strap fixing side a depending wall encompassing said middle, in which a recess is formed, the peripheral wall of said middle further comprising on one of the strap fixing sides a projection formed integrally with said peripheral wall limited by a bearing face extending substantially at right angles and radially from said wall and adapted in the assembled condition to engage said recess formed in said depending wall of said bezel, whereby said bearing face, responsive to the resilient pressure of said gasket, is pressed against the lower limiting surface of said recess the opposite strap fixing side being provided with a locking member adapted releasably to engage the peripheral wall of said middle and to be received and locked in the other recess of the wall of said crystal bezel due to the resilient action exerted by the compressed gasket against the lower limit wall of said other recess, thus firmly holding in position the crystal bezel by pressing said bezel against said middle.

2. The watertight watch case of claim 1, wherein said locking member consists of a U-shaped clamp adapted to engage with its side legs corresponding holes formed at a proper relative spacing in said middle and engaged in said other recess through which access can be had to said holes.

3. The watertight watch case of claim 1, wherein said locking member is a small disc-shaped plate adapted to be inserted through said other recess into a slot formed in the peripheral wall of said middle, said slot extending parallel to said crystal, said small disc-shaped plate, in its assembled condition, bearing with its projecting portion against the lower limiting wall of said other recess.

4. The watertight watch case of claim 3, wherein said small disc-shaped plate has a hole or notch formed in its portion emerging from said slot.

5. The watertight watch case of claim 4, wherein the width of said small disc-shaped plate decreases towards its end adapted to be inserted into said slot.

6. The watertight watch case of claim 5, wherein the shape of said slot corresponds to the narrowing shape of said small plate.

7. The watertight watch case of claim 1, wherein said locking member consists of a curved spring blade comprising in its central portion a pair of clamp forming legs, the peripheral wall of said middle comprising, just behind the wall section of said crystal bezel limiting said other recess on its lower sides, a cavity, said spring blade being adapted to engage said cavity whereby, in the assembled condition, the legs of said spring blade can encompass said bezel wall section for closing and locking the watch case, the case being opened by simply pressing said curved spring blade in said cavity.

* * * * *